US009771237B2

(12) United States Patent
Iacona

(10) Patent No.: US 9,771,237 B2
(45) Date of Patent: Sep. 26, 2017

(54) FLEXIBLE LINE STORAGE DEVICE

(71) Applicant: Fernando Iacona, Phoenix, AZ (US)

(72) Inventor: Fernando Iacona, Phoenix, AZ (US)

( * ) Notice: Subject to any disclaimer, the term of this patent is extended or adjusted under 35 U.S.C. 154(b) by 204 days.

(21) Appl. No.: 14/681,489

(22) Filed: Apr. 8, 2015

(65) Prior Publication Data

US 2015/0291384 A1 Oct. 15, 2015

Related U.S. Application Data

(60) Provisional application No. 61/977,354, filed on Apr. 9, 2014.

(51) Int. Cl.
*B65H 49/08* (2006.01)
*B65H 49/20* (2006.01)

(52) U.S. Cl.
CPC ..... *B65H 49/205* (2013.01); *B65H 2701/354* (2013.01)

(58) Field of Classification Search
CPC ..... B65H 49/205; B65H 2701/354
See application file for complete search history.

(56) References Cited

U.S. PATENT DOCUMENTS

| | | | | |
|---|---|---|---|---|
| 1,974,862 A * | 9/1934 | Cryan | B65H 75/16 | 242/146 |
| 4,913,369 A * | 4/1990 | Lia | B65H 75/40 | 242/129 |
| 5,544,831 A * | 8/1996 | Van Netta | D05B 91/16 | 206/388 |
| 5,871,091 A * | 2/1999 | Fogle | B65D 81/22 | 206/205 |
| 5,873,540 A * | 2/1999 | Hardin | B65H 75/143 | 206/406 |
| 8,230,995 B2 * | 7/2012 | Andrews | A01D 34/416 | 206/403 |

* cited by examiner

*Primary Examiner* — Sang Kim
(74) *Attorney, Agent, or Firm* — Wood, Phillips, Katz, Clark & Mortimer

(57) ABSTRACT

A flexible line storage device with a case bounding a storage space for a supply of flexible line. The case has a peripheral wall extending around a central axis and first and second axially spaced walls. The peripheral wall has a radially inwardly facing surface that, in conjunction with axially oppositely facing surfaces on the first and second walls, bounds the storage space. The first wall has a first opening through which the central axis extends. An adaptor on the first wall at least partially blocks the first opening and defines a passage through which line in the storage space moves as the line is drawn out of the storage space.

8 Claims, 3 Drawing Sheets

FLEXIBLE LINE STORAGE DEVICE

CROSS-REFERENCE TO RELATED APPLICATIONS

This application is a non-provisional of U.S. Application No. 61/977,354 filed Apr. 9, 2014.

BACKGROUND OF THE INVENTION

Field of the Invention

This invention relates to storage devices as used for supplies of flexible line and, more particularly, to a storage device in which flexible line can be displayed and from which flexible line can be controllably paid out.

Background Art

Flexible line, usable for many different applications, is commonly stored in devices in a coiled state. One example of line stored in this fashion is that used on power trimmers to cut grass and other vegetation. This type of storage device commonly: a) is used to display the line at point of purchase; b) functions as a shipping container; and c) functions to permit and control line dispensing for an end user.

Designers of this type of storage device typically strive towards developing designs that are economical to produce and simple to assemble, while at the same time producing an ample storage space from which line can be freely paid out from a coiled configuration.

SUMMARY OF THE INVENTION

In one form, the invention is directed to a flexible line storage device having a case bounding a storage space for a supply of flexible line. The case has a peripheral wall extending around a central axis and first and second axially spaced walls respectively with axially oppositely facing first and second surfaces. The peripheral wall has a radially inwardly facing surface that, in conjunction with the first and second axially oppositely facing surfaces, bounds the storage space. The first wall has a first opening through which the central axis extends. The flexible line storage device further includes an adaptor on the first wall that at least partially blocks the first opening and defines a passage through which line in the storage space moves as the line is drawn out of the storage space. The adaptor and first wall are configured as separate elements that are joined and maintained together with the adaptor in an operative state.

In one form, there are cooperating connectors on the first wall and adaptor that are configured to engage so as to maintain the adaptor in the operative state.

In one form, the cooperating connectors are configured to engage as an incident of the adaptor moving from a position fully separated from the first wall to against the first wall.

In one form, the flexible line storage device is provided in combination with a supply of flexible line in the storage space.

In one form, the flexible line in the storage space is in a coiled form around the central axis and the case has a careless configuration.

DETAILED DESCRIPTION OF THE PREFERRED EMBODIMENT

Figure 1:
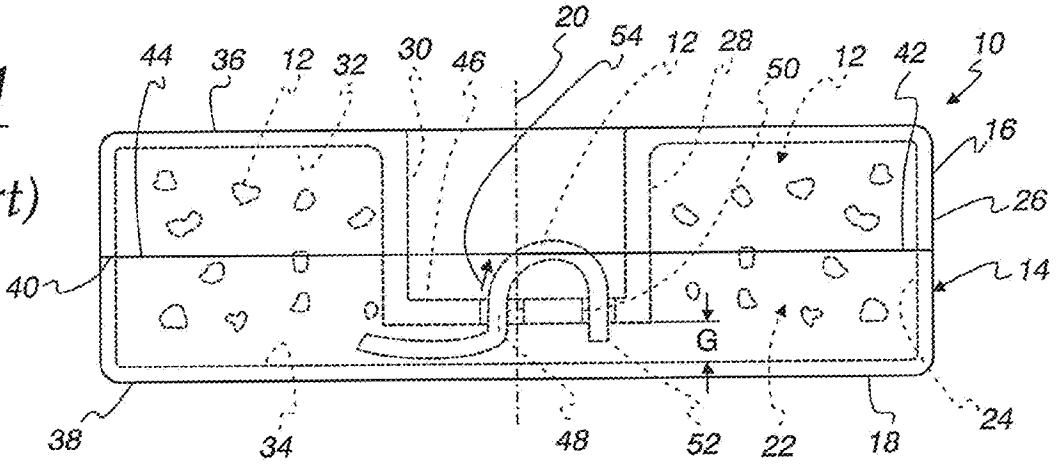
Fig. 1 (Prior Art)
FIG. 1 is a side elevation view of a conventional storage device for flexible line.
Figure 2:
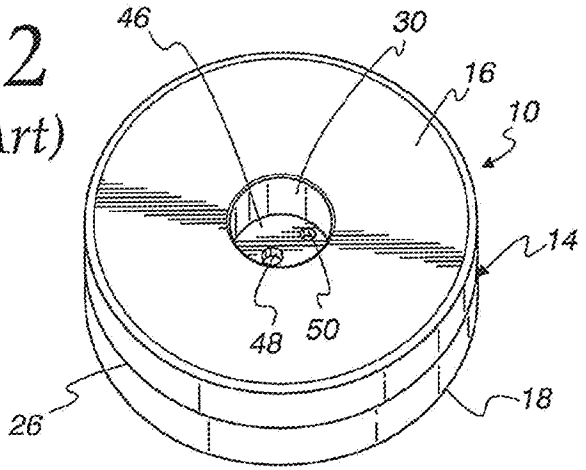
Fig. 2 (Prior Art)
FIG. 2 is a reduced, perspective view of the storage device in FIG. 1.
Figure 3:
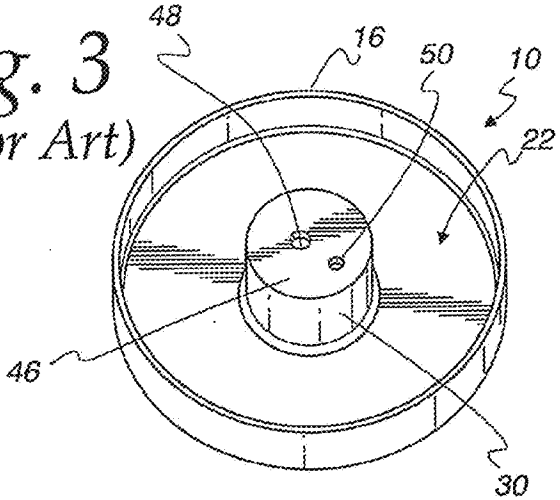
Fig. 3 (Prior Art)
FIG. 3 is a reduced, perspective view of one of two main parts making up a case on the storage device in FIGS. 1 and 2.
Figure 4:
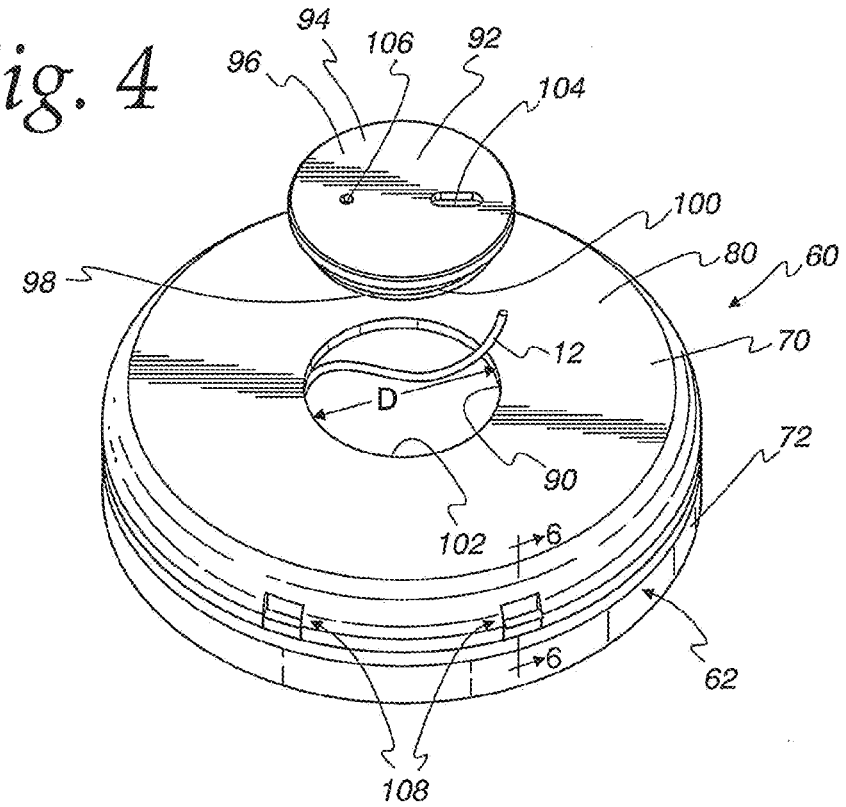
FIG. 4 is an exploded, perspective view of a flexible line storage device, according to the present invention, and including a case and separate adaptor.

In FIGS. 1-3, a conventional storage device is shown at 10 for a coiled supply of flexible line 12. The storage device 10 consists of a case 14 made up of separate, joinable first and second parts 16, 18. The case 14 has a central axis 20.

The flexible line 12, which may be configured for use in trimming/cutting vegetation, is stored in a coiled state around the central axis 12 within an annular storage space 22. The storage space 22 is bounded by: a) a radially inwardly facing surface 24 on a peripheral wall 26; b) a radially outwardly facing surface 28 on a core 30; and c) axially oppositely facing surfaces 32, 34 on axially spaced walls 36, 38, respectively on the first and second case parts 16, 18. In this embodiment, each case part 16,18 defines approximately one-half the axial extent of the peripheral wall 26.

In this embodiment, each of the case parts 16, 18 has a generally cup-shaped configuration opening oppositely in an axial direction. Annular edges 40, 42 on the case parts 16, 18 meet at a parting line 44. The edges 40, 42 may be appropriately connected, either permanently or so as to allow separation of the case parts 16, 18. No specific connecting structure is shown, with it being understood that many different variations of connecting structure are in existence in the prior art.

The core 30 is formed as one piece with the wall 36. The core 30 terminates at an end wall 46 in which radially offset openings 48, 50 are formed, with the former having a larger diameter and substantially centered upon the axis 20. A slight gap G is maintained between the end wall 46 and the surface 34.

The supply of line 12 is placed in a coiled state around the core 30. The coiled line 12, reduced to the diameter of the line storage space 22, has a tendency to enlarge in diameter, which may cause it to bear against the surface 24.

The free end 52 of the flexible line 12 is advanced in the direction of the arrow 54 through the opening 48. As tension is applied to the line 12, individual turns of the coiled line 12 can be drawn through the opening 48 to generate the desired usable length of the line 12. The slight gap G between the end wall 46 and wall 38 allows this coil reconfiguration without excessive binding.

Once the desired length of line 12 has been separated from the remaining supply thereof, the free end 52 of the line 12 in the remaining supply can be directed into the smaller opening 50. The free line end 52 thereby becomes biasably held to avoid inadvertent further payout of line 12.

While the conventional configuration has generally been functional, there is some room for improvement. First of all, the requirement of the core 30 necessitates the use of additional material, which typically is a moldable plastic.

Further, the described configuration makes it somewhat difficult to thread line from the coiled supply into and through the opening 48. In the event that the line 12 is inadvertently severed within the storage space 22, it would be difficult to redirect the line end back into the opening 48 without compromising the case 14.

Still further, there is a certain amount of binding that may occur between the case 14 and line 12 by reason of the relatively narrow gap G between the end wall 46 and wall 38. If the line 12 does not uncoil predictably, it could bind and/or kink in the gap region.

These problems are particularly significant in the event of a permanent bonding of the case parts 16, 18.

A preferred form of flexible line storage device, according to the present invention, is shown at 60 in FIGS. 4-9. The line storage device 60 consists of a case 62 bounding a storage space 64 for a supply of the flexible line 12.

The case 62 has a peripheral wall 66 extending around a central axis 68. The peripheral wall 66 is defined cooperatively by first and second joinable case parts 70, 72. Each of the case parts 70, 72 has a generally cup-shaped configuration opening axially towards the cooperating case part 70, 72. In this embodiment, the case parts 70,72 have substantially the same axial extent, though this is not required. Each case part thus bounds an axial portion of the volume of the storage space 64. Annular edges 74, 76 on the case parts 70, 72, respectively, meet at a parting line 78.

The first and second case parts 70, 72 have first and second axially spaced walls 80, 82 with axially oppositely facing surfaces 84, 86, respectively. The surfaces 84, 86 are substantially flat. The storage space 64 is defined cooperatively by the surfaces 84, 86, and the radially inwardly facing surface 88 on the peripheral wall 66. This embodiment utilizes a coreless configuration, though a core could be incorporated in an alternative design.

The first wall 80 has a flat portion with an opening 90 therethrough. The central axis 68 extends through the opening 90 and may be coaxial therewith.

Figure 5:
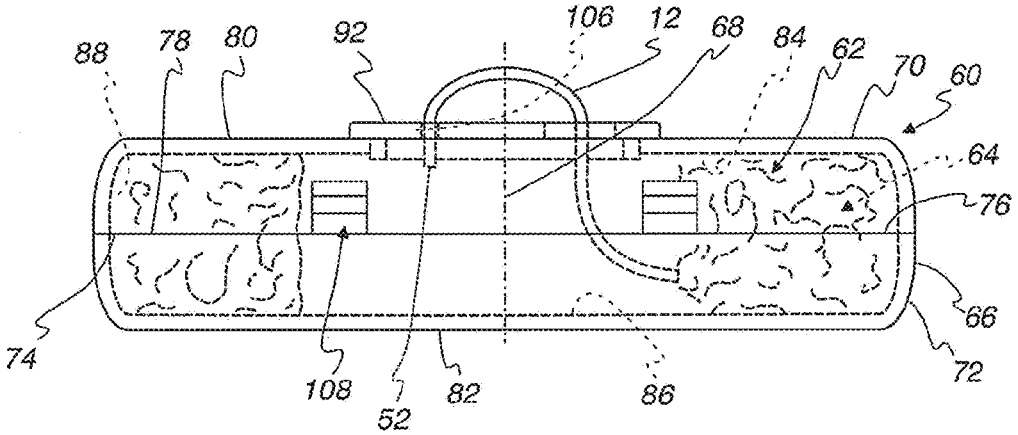
FIG. 5 is a side elevation view of the storage device in FIG. 4 in an assembled state.
Figure 6:
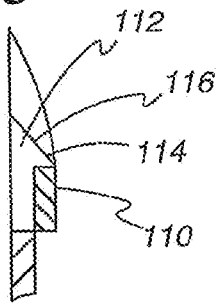
FIG. 6 is a fragmentary, cross-sectional view, taken along lines 6-6 in FIG. 4, and showing cooperating parts on a connector for joining separate parts on the case and with the connector parts engaged.
Figure 7:
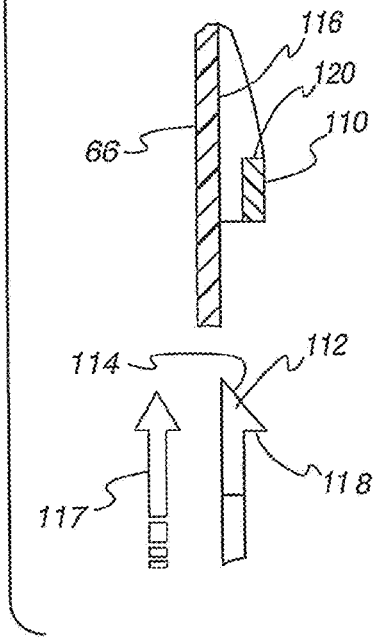
FIG. 7 is a view as in FIG. 6 with the connector parts spaced from each other in a pre-assembly relationship.

An adaptor 92 is formed separately from the first wall 80 and is designed to at least partially block the opening 90 with the adaptor 92 in an operative state as shown in FIG. 5. In this embodiment, the adaptor 92 is press fit into its operative state at the flat wall portion.

More particularly, the adaptor 92 consists of a wall 94 with an exposed surface 96 having an area to completely block the opening 90 with the adaptor 92 in its operative state. The wall 94 and opening 90 have the same round shape with the wall 94 having a larger diameter to overlie and fully block the opening 90. The wall 94 has a depending annular connector 98 with a radially outwardly facing surface 100 with a diameter less than that of the surface 96 and generally matched to an edge 102 bounding the opening 90 so that the adaptor 92 can be press fit and frictionally held by the edge 102 with the adaptor 92 in its operative state. The surface 100 and edge 102 act as cooperating connectors that engage so as to maintain the adaptor 92 in its operative state simply as an incident of the adaptor 92 moving from the FIG. 4 position, fully separated from the first wall 80, to against the first wall 94 as shown in FIG. 5.

The adaptor 92 has an elongate opening 104 that defines a passage through which line 12 from the storage space 64 can be directed and through which the line 12 moves as it is drawn out of the storage space 64. A separate opening 106 is formed in the adaptor 92 into which the free end 52 of the line can be pressed, and biasably held through restoring forces produced by bending, to avoid inadvertent payout of the line 12 when the line 12 is simply being stored.

The diameter D of the opening 90 may be sufficiently large that a user can extend his/her hand into the storage space 64 with the adaptor 92 removed to reposition the stored line 12 as may be desirable or necessary, as when there is entanglement or binding. Access is unimpeded with the coreless construction.

The above-described construction lends itself to being formed, as from plastic, using conventional molding techniques.

In one form, the case parts 70, 72 are maintained together using connectors 108 at angularly spaced locations. Each connector 108, shown in detail in FIGS. 6 and 7, consists of cooperating connector parts 110, 112, respectively on the first and second case parts 70, 72. The connector part 112 has an angled surface 114 that can be wedged between the connector part 110 and an undercut surface 116 on the peripheral wall 66, as it is moved in the direction of the arrow 117 from the FIG. 7 position into the FIG. 6 position, thereby to wedge the connector part 110 away from the surface 116. Once a trailing edge 118 on the connector part 112 clears the connector part 110, the connector port 110 springs back from its deformed state, as an incident of which the edge 118 is placed in confronting relationship with an edge 120 on the connector part 110, to maintain the case parts 70, 72 together.

Figure 8:
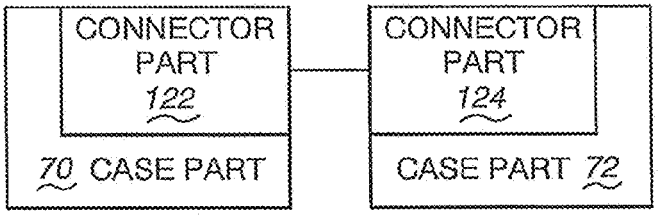
FIG. 8 is a schematic representation of connector parts to maintain the case parts, in the device in FIGS. 4-7, together.

The invention contemplates virtually an unlimited number of different configurations for connectors/connector parts for the case parts 70, 72, as depicted schematically in FIG. 8, which shows cooperating connector parts 122, 124 that may establish either a releasable or permanent connection.

Figure 9:
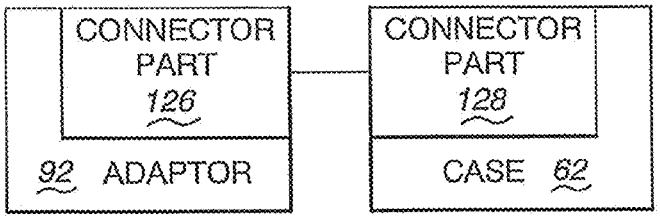
FIG. 9 is a schematic representation of different connector parts on connectors used to maintain the adaptor, in FIGS. 4 and 5, in an operative state on the case.

Likewise, as shown in FIG. 9, the invention contemplates virtually an unlimited number of connector/connector part configurations, cooperating between the adaptor 92 and case 62, with connector parts that cooperate therebetween shown schematically at 126 and 128 therein.

Figure 10:
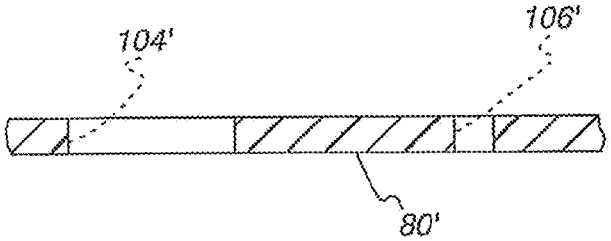
FIG. 10 is a fragmentary, cross-sectional view of a wall on a modified form of device, according to the invention.

While not preferred, as shown in FIG. 10, the invention also contemplates that openings 104', 106', corresponding to the openings 104, 106 shown on the device 60, may be formed in a wall 80', corresponding to the wall 80, without a separate adaptor.

The foregoing disclosure of specific embodiments is intended to be illustrative of the broad concepts comprehended by the invention.

The invention claimed is:

1. A flexible line storage device comprising:

a case bounding a storage space for a supply of flexible line, the case having a peripheral wall extending around a central axis and first and second axially spaced walls respectively with axially oppositely facing first and second surfaces, the peripheral wall having a radially inwardly facing surface that, in conjunction with the first and second axially oppositely facing surfaces, bounds the storage space, the first wall having a first opening through which the central axis extends; and an adaptor on the first wall that at least partially blocks the first opening and having a separate opening there through that defines a passage through which line in the storage space moves as the line is drawn out of the storage space, the adaptor and first wall configured as separate elements that are joined and maintained together with the adaptor in an operative state.

2. The flexible line storage device according to claim 1 wherein there are cooperating connectors on the first wall and adaptor that are configured to engage so as to maintain the adaptor in the operative state.

3. The flexible line storage device according to claim 2 wherein the cooperating connectors are configured to engage as an incident of the adaptor moving from a position fully separated from the first wall to against the first wall.

4. The flexible line storage device according to claim 1 in combination with a supply of flexible line in the storage space.

5. The flexible line storage device according to claim 1 wherein the flexible line in the storage space is in a coiled form around the central axis and the case has a coreless configuration.

6. The flexible line storage device according to claim 1 wherein the first wall has a flat portion through which the first opening is formed and the adaptor is joined to the flat portion of the first wall.

7. The flexible line storage device according to claim 1 wherein the axially oppositely facing surfaces are substantially flat and parallel to each other.

8. The flexible line storage device according to claim 1 wherein the case is defined by separate parts joined together and each bounding an axial portion of a volume of the storage space.

* * * * *